United States Patent [19]

Almeras et al.

[11] Patent Number: 5,010,811

[45] Date of Patent: Apr. 30, 1991

[54] MARKING DEVICE ADAPTED FOR MOUNTING ON A FASTENER DRIVING APPARATUS

[75] Inventors: Roland Almeras; Patrick Herelier, both of Tournon, France

[73] Assignee: Societe de Prospection et D'Inventions Techniques (S.P.I.T.), Cedex, France

[21] Appl. No.: 373,976

[22] Filed: Jun. 30, 1989

[30] Foreign Application Priority Data

Jul. 1, 1988 [FR] France ..... 88 08927

[51] Int. Cl.[5] ..... B31F 1/00

[52] U.S. Cl. ..... 101/3.1; 101/28; 101/29; 101/4

[58] Field of Search ..... 101/3.1, 5, 22, 28, 101/29, 30, 31, 35, 36, 4

[56] References Cited

U.S. PATENT DOCUMENTS

| | | | |
|---|---|---|---|
| 2,271,500 | 1/1942 | Rickenbach | 101/28 |
| 2,333,716 | 11/1943 | Hamnett | 101/28 |
| 2,455,270 | 11/1948 | Ravella | 101/3.1 |
| 2,558,616 | 6/1951 | Johnson | 101/3.1 |
| 3,116,683 | 1/1964 | Krembel, Jr. | 101/28 |
| 4,006,786 | 2/1977 | Speicher | 101/3.1 |
| 4,159,676 | 7/1979 | Joyce et al. | 101/3.1 |
| 4,265,172 | 5/1981 | El-Souessi | 101/29 |

FOREIGN PATENT DOCUMENTS

| | | | |
|---|---|---|---|
| 235301 | 10/1961 | Australia | 101/28 |

*Primary Examiner*—Edgar S. Burr
*Assistant Examiner*—Ren Yan
*Attorney, Agent, or Firm*—Schwartz & Weinrieb

[57] ABSTRACT

A marking device is provided so as to be movably mounted upon the mouth or open end of the barrel (1) of an explosive or propulsive driving apparatus. It comprises a flexible case (11) fixed upon an anvil (10) which is intended to transmit the energy of the piston (4) of the apparatus to a series of punches (14) disposed within the case and whose stroke is controlled by means of a damping pad (19) which is resiliently deformed during marking.

25 Claims, 7 Drawing Sheets

MARKING DEVICE ADAPTED FOR MOUNTING ON A FASTENER DRIVING APPARATUS

FIELD OF THE INVENTION

The present invention relates generally to marking devices, and more particularly to a marking device which is adapted for mounting upon an apparatus comprising, a piston disposed within a barrel and intended to be driven in translation under action of the combustion gases of a propulsive charge, which device further comprises a case containing at lease one punch adapted to be moved under the action of the piston of the explosive or propulsive driving apparatus.

The present invention relates to a cold marking operation using a special apparatus which comprises an indirect explosive or propulsive driving apparatus.

BACKGROUND OF THE INVENTION

Marking is understood the punching of particular information, such as for example a date, upon workpieces. It then is a question of date marking.

Known marking devices being currently used are formed of a metal case, generally in two parts, which is fixed to the barrel of the apparatus and which contains a freely moving inertia block, very often urged towards the punches by means of a spring and which, under the action of the piston of the apparatus, in its turn drives the punches, these latter sometimes being held within passages formed within the case, such as, for example taught by means of the documents ER-A-2 389 425 and 2 456 570 for providing marking indicia. The punches may moreover be replaced by means of rotary wheels for a rapid change of characters.

These devices are relatively expensive and exhibit an excessive amount of weight.

SUMMARY OF THE INVENTION

The present invention thus provides a marking device which is light in weight, can be manufactured at a reduced cost and is formed as a single piece.

More particularly, the present invention relates to a device of the above-mentioned type, characterized by the fact that the case is made in one piece, its material is flexible, it is movably mounted with respect to the barrel of the apparatus and it contains an anvil for transmitting the energy of the piston of the apparatus to the punch.

The mobility of the case with respect to the barrel makes it possible to readily absorb the inertia due to the recoil of the apparatus.

The material forming the case of the device of the invention is made from a flexible material and may moreover be light and resiliently deformable so as to be resiliently deformed upon the workpiece to be marked at the time of the impact of the piston upon the anvil. The case may be obtained by means of a molding process, may be made from a suitable resilient or plastic material, such as, for example, polyurethane or may even be made from several parts formed of different materials, which may then be assembled together, e.g. by means of screws, so as to effectively preserve the one-piece character of the case. Because of the mobile or telescopic character of the case of the device, relative to the barrel, a good contact between the marking punch or punches and the workpieces or the material to be marked is effectively achieved.

The anvil may be molded within the case or be fixed thereto, such as, for example by means of shafts fixed within the case and always retaining the anvil at its initial position because of the flexibility or resiliency of the case.

The case may comprise means, advantageously, for example recesses in the form of grooves, for facilitating the resilient deformation the case during marking.

The rear part of the barrel, situated towards the charge, may comprise a damping assembly for absorbing the inertia due to the sudden recoil of the piston after the latter has bounced back from the anvil thereby prolonging the active life of the piston.

The case may be adapted to be moved under the action of piston of the apparatus against the action of the return means, which bear against a shoulder of the case and a shoulder of an end piece of the barrel or of the barrel itself.

In accordance with a particular embodiment of the device of the present invention, at least, one marking disk is provided so as to be mounted for rotation within the case and which cimprises a series of useful punching portions, and still further, there is also provided means for immobilizing the disk against rotation.

In accordance with another embodiment, whereby in particular it is possible to use the device upon curved surfaces, the anvil contained within the case is provided with guide passages for the punches, the case, because of the flexibility and elasticity of its material, confining the movement of the anvil.

Preferably, the front portion of the case of the device of the present invention, distant from the explosive charge end of the apparatus, is provided with a pad which is adapted for completing the bearing relation of the case upon the workpiece to be marked and for absorbing a portion of the excess energy, not required for the punching operation and thus improving the quality of the marking operation, by avoiding excessive amount of deformation of the workpiece or of the material to be marked, particularly if it is a question of plates of small thickness and by limiting the bouncing phenomenon prejudicial to this desired quality.

The pad may extend either within the plane of the marking character of the punch, may alternatively be recessed with respect to this plane or may project beyond this plane. In place of the pad, at least one spring-mounted damping pin may also be provided.

BRIEF DESCRIPTION OF THE DRAWINGS

The present invention will be better understood from the following description of several embodiments of the marking device of the present invention, with reference to the accompanying drawings, in which like reference characters designate like or corresponding parts throughout the several views, and wherein.

DETAILED DESCRIPTION OF THE ILLUSTRATED EMBODIMENTS

Figure 1:
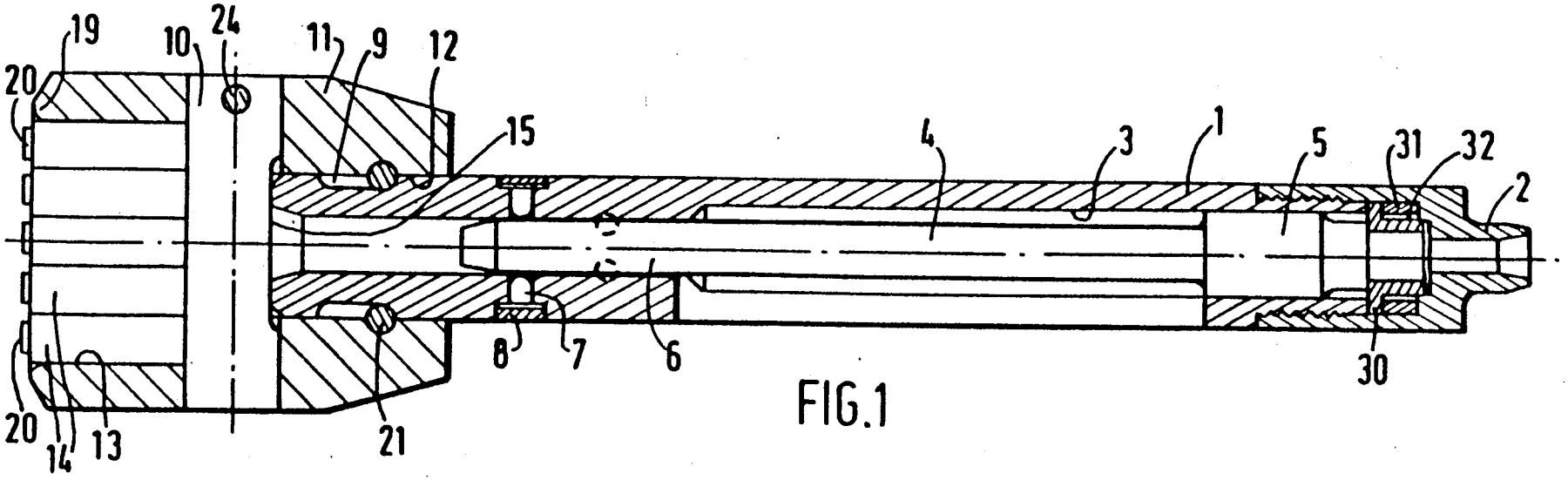
FIG. 1 is a diagrammatic view of a first embodiment of the marking device of the present invention, mounted upon an explosive or propulsive driving; apparatus, in cross-section along the axis of the apparatus.

Referring now to FIG. 1, the marking device of the present invention, which will be described in accordance with its several of its embodiments, is intended to be used with and mounted upon an indirect explosive or propulsive driving apparatus. It is a well known apparatus and only its parts required for understanding the assembly and operation of the marking device of the present invention will be described.

The explosive or propulsive driving apparatus comprises a barrel 1 upon the rear part of which a charge holder 2 is threadedly engaged within the bore 3 of the barrel a piston 4 is mounted, introduced here through the rear of the barrel, which is intended to be driven forwards under the action of the combustion gases of a propulsive charge, after percussion thereof, housed within the charge holder 2. Piston 4 has a head 5 substantially of the same cross section as the bore 3 of the barrel. The rod 6 of piston 4 is maintained at an axial position within the barrel by means of transverse pins 7 subjected to the stress of an annular keeper 8.

A system for damping the piston is interposed between the barrel and the charge holder. It is formed of a steel ring 30 upon which the piston bears and a resilient ring 31 which may be axially compressed and then radially expanded as a result of the provision of an expansion space 32 formed between ring 31 and ring 30. After mounting, and threadedly fixing the charge holder 2 upon barrel 1, the steel ring 30 normally urged forwards against the barrel by means of the resilient ring 31 may be driven rearwardly with a translational movement defined by means of the damping distance under the action of the return of the piston.

The front part of barrel 1 comprises two flat diametrically opposite milled portions for mounting the marking device, as will be explained hereafter.

Figure 2:
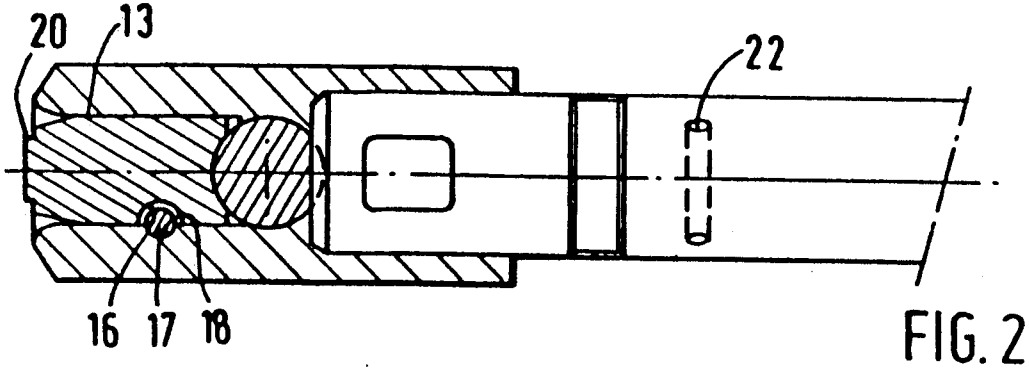
FIG. 2 is a diagrammatic sectional view, orthogonal to that of FIG. 1.

The marking device shown in FIGS. 1 and 2 has a generally parallelepipedic configuration. It comprises an anvil 10 in the form of a cylindrical bar, disposed and held within an annular case 11, such that its two ends are flush with the external surface of the case. Case 11 has, at the rear end, thereof a cylindrical opening 12 for receiving the front portion of the barrel which is normally in contact with the anvil. At the front end thereof it has a parallelepipedic opening 13 for receiving a series of marking punches 14, aligned in a diametrical plane of the barrel of the apparatus and extending outwardly from the case 11.

Anvil 10 is fixed to case 11 by means of a through shaft 24. It comprises a flat portion 15 forming the bottom of a recess for receiving the barrel and serving as a support for the front end of the barrel 1.

The punches 14 each includes a groove 16 for receiving, with clearance, a retention shaft 17 which is also received, upon the other side thereof and still with clearance, within a groove 18 of case 11. The punches 14 may then move slightly within the case. The front portion of case 11 forms a deformable absorption pad 19 whose end plane, in the rest position, is substantially at the same level as the plane of the marking characters of the punches. The marking device is mounted upon the barrel 1 of the apparatus by sliding it, by means of its opening 12, over the mouth or open end of the barrel and subsequently driving through the wall of the case, through means end two openings provided for this purpose, the two legs 21 of a locking pin cooperating with milled portion 9 of the barrel.

The marking device may thus slidably move over the barrel to a limited degree.

After positioning the device against the workpiece to be marked and firing, the charge disposed within the charge holder 2 piston 4 is propelled forwards and strikes anvil 10, which causes the assembly formed by means of the device, anvil, punches and case to move accordingly move forward and thus cause marking, of the workpiece the predetermined position of the pad limiting the penetration of the device and the punches into the workpiece to be marked.

Vent holes 22 defined within the barrel are provided for discharging the propulsive gases so as to avoid undue stressing of the case.

Figure 7:
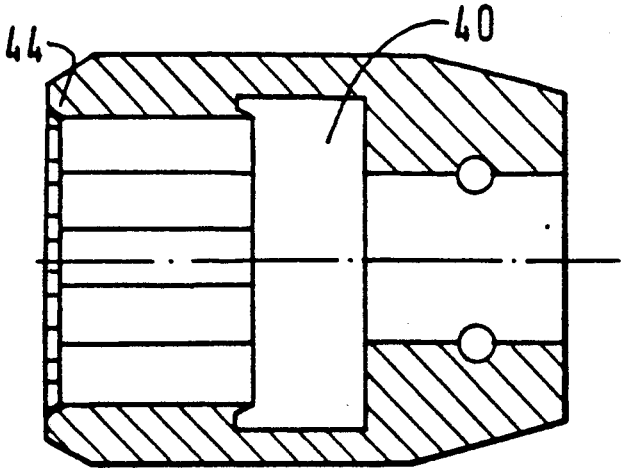
FIG. 7 is a diagrammatic sectional view of a fourth embodiment of the present invention.

The device of FIG. 7 is substantially identical to that of FIGS. 1 and 2. It is however distinguished therefrom by means of its anvil 40, upon which the case has been directly molded. Furthermore, the deformable absorption pad 44 of the case has an end plane which merges with the plane of the marking characters of the punches.

Figure 3:
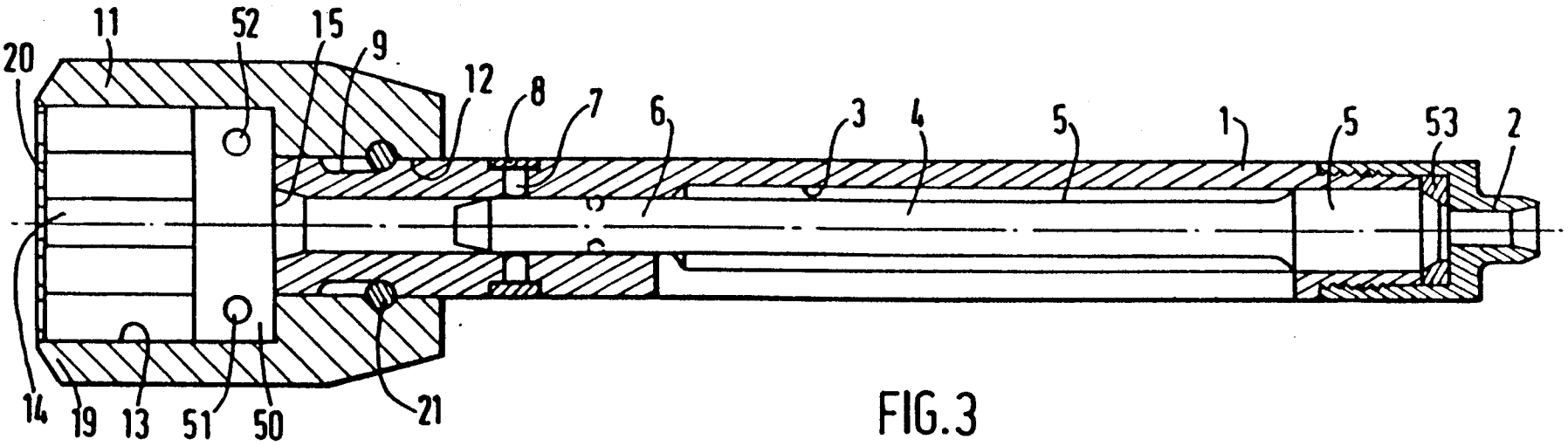
FIG. 3 is a view similar to that of FIG. 1, of a second embodiment of the device of the present invention.
Figure 4:
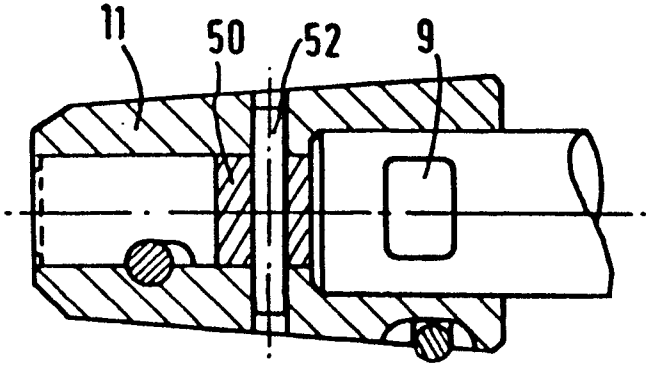
FIG. 4 is a diagrammatic sectional view, orthogonal to that of FIG. 3.

Referring to FIGS. 3 and 4, in which the elements similar to those of FIGS. 1, 2 bear the same reference characters, anvil 50 is held within the case by means of two pins 51, 52. The rear part of the barrel is provided with a device, for damping the piston, which formed of a single ring 53 made from a low hardness steel and which within addition may have a truncated cone shape in which the piston comes to bear.

Figure 5:
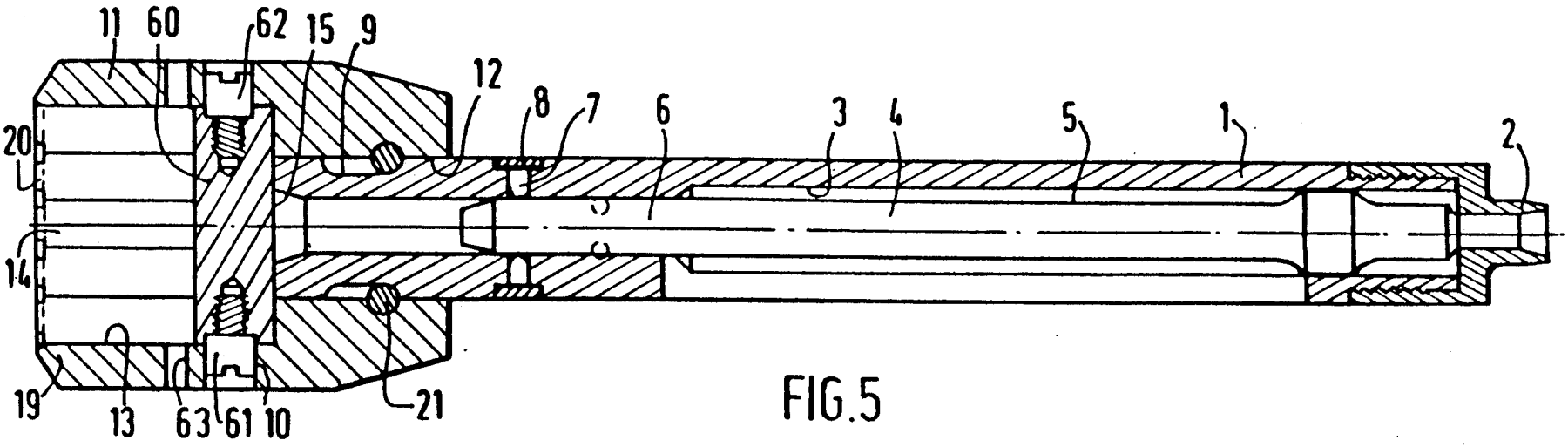
FIG. 5 is a view similar to that of FIG. 1, of a third embodiment of the device of the present invention.
Figure 6:
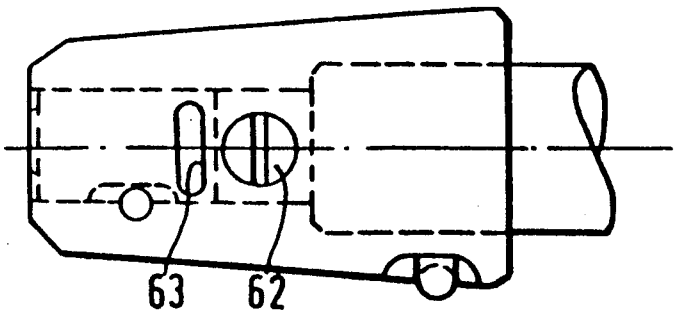
FIG. 6 is a diagrammatic sectional view, orthogonal to that of FIG. 5.

In the embodiment shown in FIGS. 5, 6, in which the elements similar to those of FIGS. 1, 2, bear the same reference characters, anvil 60 is fixed within case 11 by means of screws 61, 62, which bear upon the case, and wherein further, the case comprises a pair of recesses 63 formed at a certain distance from the head of the screws so as to permit movement of the anvil 60 due to such added the resilience of the case. Such a characteristic is further advantageous in all the embodiments, for increasing the flexibility of the case.

Figure 11:
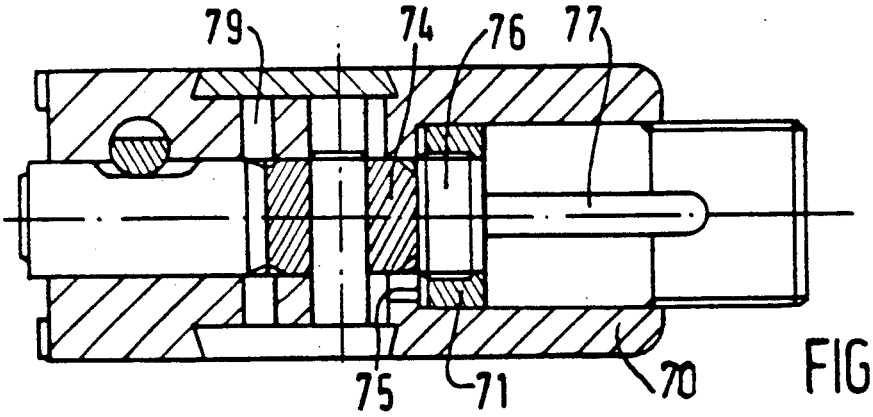
FIG. 11 is a diagrammatic sectional view of a seventh embodiment of the device of the present invention.
Figure 12:
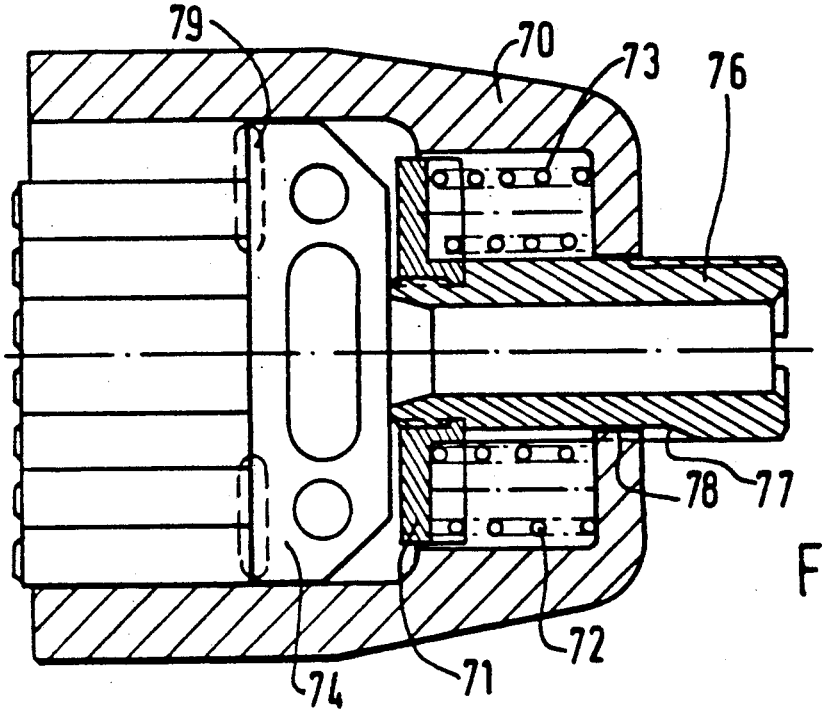
FIG. 12 is a diagrammatic sectional view, orthogonal to that of FIG. 11.
Figure 13:
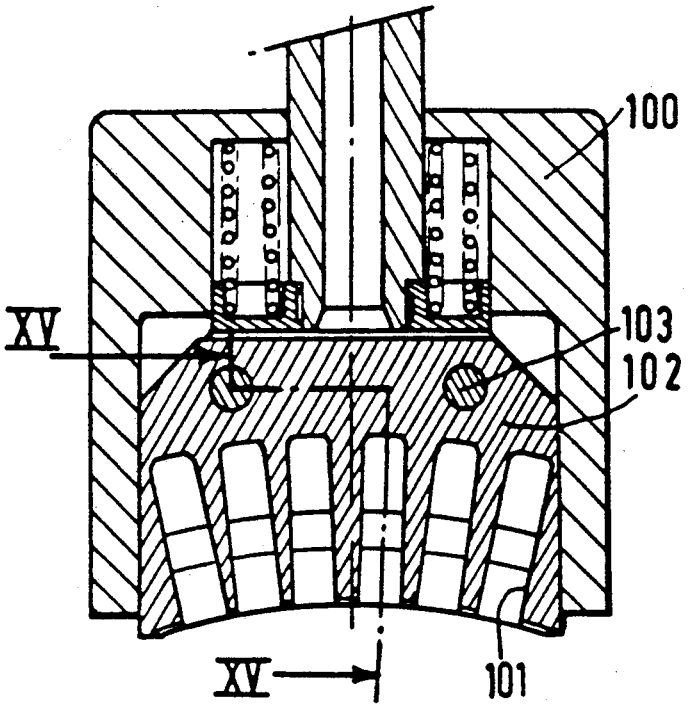
FIG. 13 is a diagrammatic sectional view of an eighth embodiment of the device of the present invention, for use in connection with the marking of concave surfaces.
Figure 15:
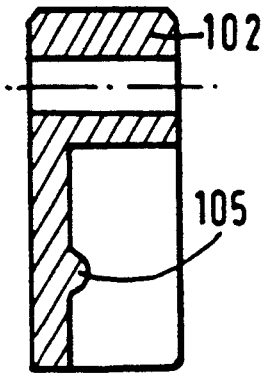
FIG. 15 is a diagrammatic sectional view of the anvil of the device of FIG. 13 taken along line XV—XV.
Figure 14:
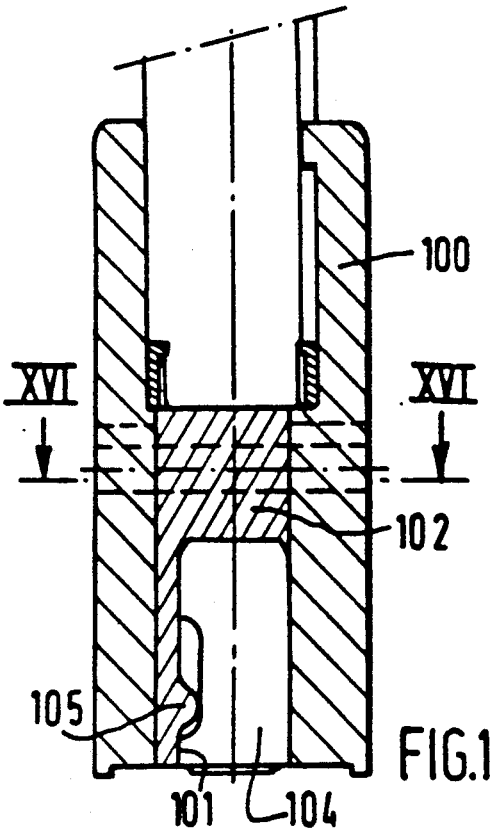
FIG. 14 is a diagrammatic sectional view, orthogonal to that of FIG. 13.

Turning now to FIGS. 11 and 12, the device comprises a case 70 which receives a base 71 upon which springs 72, 73 bear so as to bias base 71 towards anvil 74 and against a shoulder 75 of the case. The barrel 76 is in this case threaded directly into base 71, but it could be threadedly engaged by means of an additional part. Barrel 76 comprises one or more grooves 77 for fixing the case against rotation upon the barrel, the case being formed correspondingly at 78 so as to resiliently engage the grooves 77. As may be provided within the embodiments shown in FIGS. 1 and 4, furthermore similar to that of FIGS. 11 and 12, the case has recesses 79 for providing enhanced elasticity or resiliency and flexibility.

Figure 8:
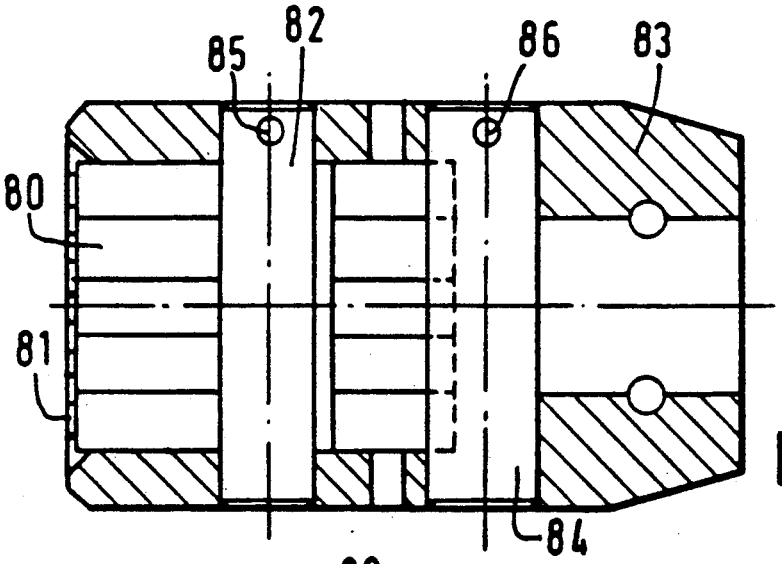
FIG. 8 is a diagrammatic sectional view of a fifth embodiment of the present invention.
Figure 9:
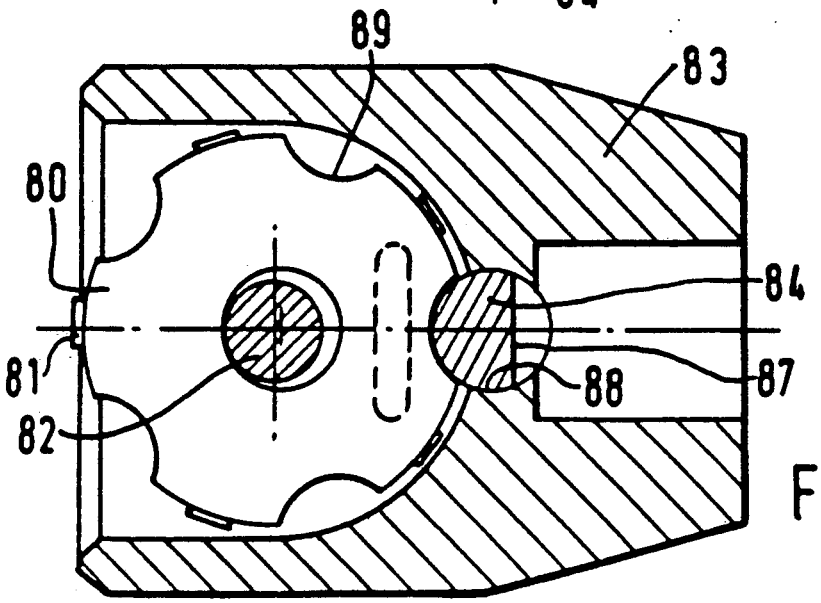
FIG. 9 is a diagrammatic sectional view, orthogonal to that of FIG. 8.

The device of FIGS. 8 and 9 is distinguished from those of the preceding Figures essentially by means of the marking punches which are in this case disks 80, still disposed side by side and each having a series of marking characters 81 circumferentially spaced apart at their periphery, thus offering a series of several different possible markings. Disks 80 are mounted for rotation with play upon a retention shaft 82 which is mounted within case 83. Shaft 82 and anvil 84 are in this instance connected to the case by means of pins 85 and 86, respectively.

The anvil 84 has a flat surface 87 extending over a length which is substantially equal to the sum of the thicknesses of disks 80, and in addition, surface 87 is disposed at a distance, from the diametrical plane to which is it parallel, which is substantially equal to the difference between, on the one hand, the distance from the axis of the case groove 88 housing anvil 84 to the front end plane of case 83 and, on the other hand, the overall diameter of disks 80.

The disks 80 have peripherally circular indentations 89 which have a radius which is the same as the radius of anvil 84. At the position of the elements shown in FIGS. 8 and 9, the marking disks are locked against rotation by means of the anvil because the clearance defined between disks 80 and shaft 82 upon which they are mounted is less than the engaged distance or indicia thereon define between the disks and the anvil. In order to change the elements, it is sufficient to loosen the anvil from the case and to rotate it about its axis through means of 180 degrees so that flat surface 87 disposed opposite the disks—or to alternatively remove the anvil so that rotation of the disks is possible. In this embodiment, it is also possible to provide recesses within the case for improving the resilience thereon.

Figure 10:
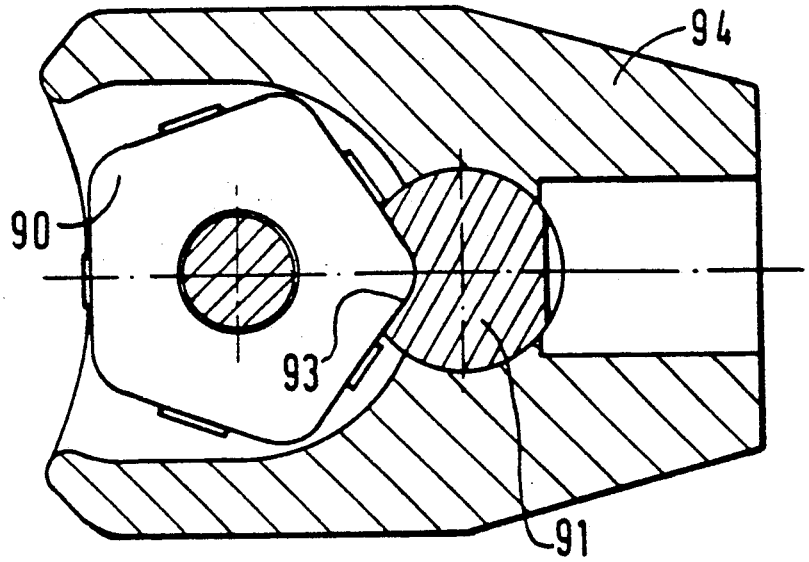
FIG. 10 is a diagrammatic sectional view of a sixth embodiment of the present invention.

The device of FIG. 10 is distinguished from that of FIGS. 8 and 9 by the fact that the punch disks 90 are polygonal and that anvil 91 is therefore provided with a corresponding V shaped groove 93, the wheels being so as to change the marking elements and indicia thereon after the anvil has been removed from the case 94. In this case, the special shape of case 94 should be noted which makes marking upon a cylindrical portion or surface possible.

Figure 16:
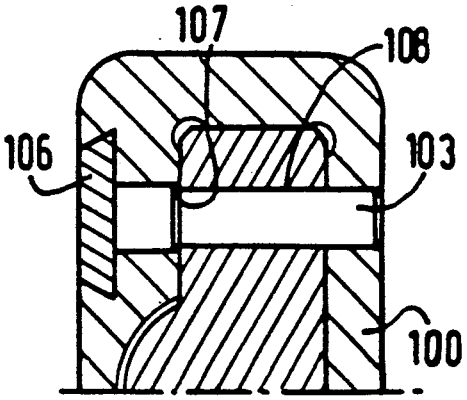
FIG. 16 is a sectional view of the device of FIG. 14 taken along line XVI—XVI.

FIGS. 13 to 16 show one embodiment of the device for marking curved, concave or convex surfaces. Case 100 is formed from a flexible material; the anvil 102 is connected to the case by means of shafts 103. Case 100 is still the same whatever the marking radius chosen, but the comformance of anvil 102 depends upon this radius. In fact, depending upon the dimensions of the surface to be marked, the anvil must have an appropriate radius of curvature. However, it still comprises channels 101 for guiding the punches 104 and bosses 105 for holding the punches therein. Shafts 103 are in this case fixedly retained within case 100 by means of closure members 106, mounted within the case 100 as seen in FIG. 16. A shoulder 107 of greater diameter than hole 108 for receiving shafts 103 is formed upon each shaft 103 for preventing it from passing through anvil 102. The change in the radius of the workpieces to be marked therefore only requires replacement of the anvil contained within the case.

Independently of the other elements contained within the case of the device, the damping pad thereof may have several appropriate shapes and arrangements in particular for completing the bearing relation of the case upon the workpiece or material to be marked, for absorbing the excess amount of energy of the piston of the apparatus, and for preventing, by controlling them, too great a deformation of the workpiece or material to be marked and too great a penetration of the punches with respect to the workpiece being marked, thereby improving the marking quality.

Figure 17A:
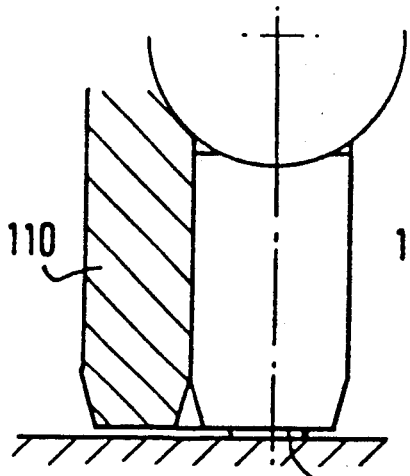
FIGS. 17A and 17B are sectional views of a first embodiment of an absorption pad for use within the device of the present invention, in the rest position and in the marking position, respectively.
Figure 17B:
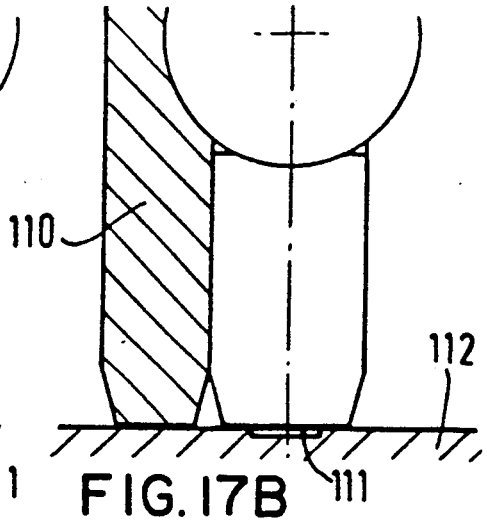

The pad 110 of FIGS. 17A an 17B has a trapezoidal section and is slightly recessed, at rest, with respect to the marking character 111. It makes possible maximum deformation, well adapted to a workpiece 112 of small thickness, by absorbing the surplus energy.

Figure 18A:
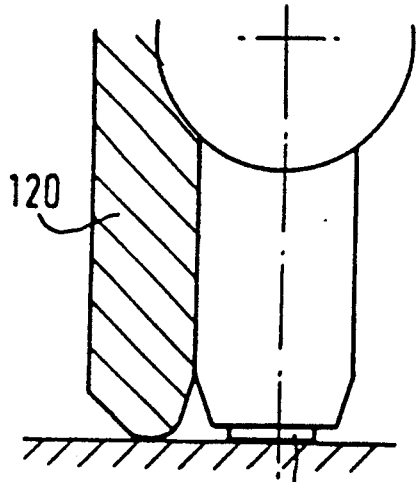
FIGS. 18A and 18B are views, similar to those of the preceding figures, of a second embodiment of an absorption pad constructed in accordance with the present invention.
Figure 18B:
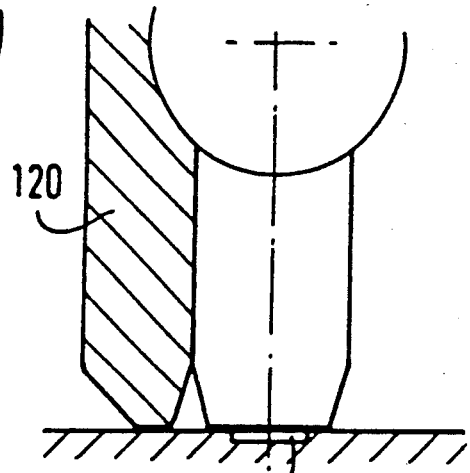

Pad 120 of FIGS. 18A and 18B is situated with its end face disposed within the plane of the marking characters 121. During marking, it is progressively deformed. It is particularly adapted for fine plates and for avoiding any damage due to bouncing of the apparatus.

Figure 19A:
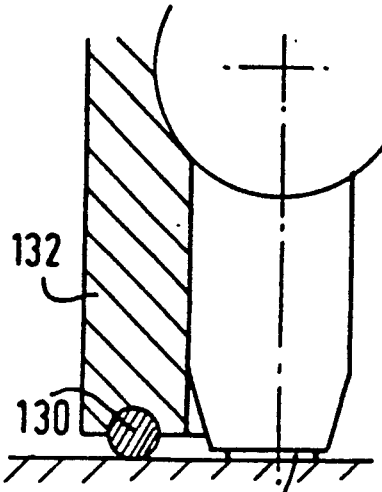
FIGS. 19A and 19B are views, similar to those of the four preceding figures, of a third embodiment of an absorption pad constructed in accordance with the present invention.
Figure 19B:
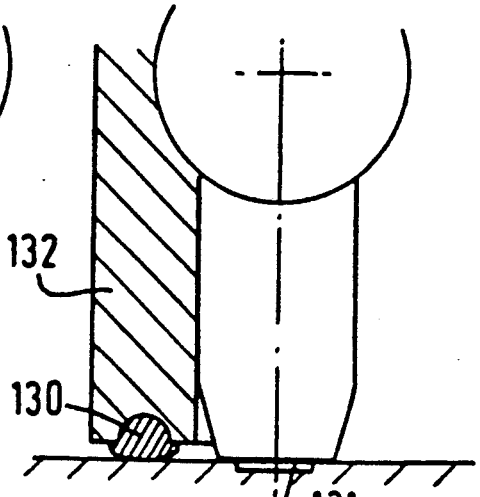

The pad 130 of FIGS. 19A and 19B is a flexible toroid mounted within the front end surface of case 132. It fulfills the same functions as the preceding pads.

Obviously, many modifications and variations of the present invention are possible in light of the above teachings. It is therefore to be understood that within the scope of the appended claims, the present invention may be practiced otherwise than as specifically described herein.

We claim:

1. A marking device, comprising:

a barrel;

a piston movably disposed within said barrel between a first stored position and a second actuating position;

means for moving said piston between said first stored position and said second actuating position;

a case movably mounted upon one end of said barrel such that said one end of said barrel is disposed within said case and said case is movable with respect to said one end of said barrel between a marking position and a non-marking position;

at least one punch, having marking indicia thereon, mounted within said case; and an anvil fixedly mounted upon said case for receiving an actuating force from said piston, said anvil, said case, and said at least one punch all being substantially fixed with respect to each other and collectively defining a unit which is mounted upon said barrel for movement with respect to said barrel when said piston is moved from said first stored position to said second actuating position so as to act upon said anvil and move said case, said anvil, and said at least one punch from said non-marking position to said marking position.

2. A marking device as set forth in claim 1, wherein:

said means for moving said piston comprises propulsive charge means for generating combustion gases for acting upon said piston.

3. A marking device as set forth in claim 1, wherein:

said at least one punch comprising a plurality of punches aligned along a diametrical plane of said barrel.

4. A marking device as set forth in claim 1, further comprising:

recess means defined within one surface of said anvil for receiving and end of said barrel through which said piston is projected into contact with said anvil by said piston moving means when said piston is moved from said first stored position to said second actuating position.

5. A marking device as set forth in claim 1, further comprising:

shaft means disposed transversely through said case and said anvil, with respect to a longitudinal axis of said anvil, for fixedly mounting said anvil within said case.

6. A marking device as set forth in claim 4, further comprising:

recess means defined within opposite sides of said end of said barrel disposed upon said surface of said anvil; and locking pin means disposed within said recess means of said barrel, and within said case, for permitting said relative movement of said case with respect to said barrel.

7. A marking device as set forth in claim 2, further comprising:

vent means defined within said barrel for discharging said combustion gases after said combustion gases have moved said piston from said first stored position to said second actuating position.

8. A marking device as set forth in claim 1, wherein:

said anvil and said case comprise an integral molding.

9. A marking device as set forth in claim 1, further comprising:

a pair of parallel pins disposed transversely through said case and said anvil, with respect to a longitudinal axis of said anvil, for fixedly mounting said anvil within said case.

10. A marking device as set forth in claim 1, further comprising:

a pair of oppositely disposed, co-axially aligned screws disposed transversely through opposite sides of said case, and along a longitudinal axis of said anvil, for fixedly mounting said anvil within said case.

11. A marking device as set forth in claim 1, further comprising:

a surface of said anvil is disposed in contact with an end portion of said barrel when said anvil, said case, and said at least one marking punch are disposed at said non-marking position; 'recess means defined within said end portion of said barrel;

an end portion of said case, disposed remote from an opposite end portion within which said at least one marking punch is disposed, having radially inwardly extending flange means for reception within said recess means of said barrel; and spring-biasing means interposed between said flange means of said case and said end portion of said barrel for biasing said case, said anvil, and said at least one marking punch from said marking position back toward said non-marking position.

12. A marking device as set forth in claim 1, wherein:

said at least one marking punch comprises a plurality of coaxial discs each of which has a plurality of marking indicia mounted thereon at circumferentially spaced locations, and a plurality of recesses, defined at circumferentially spaced locations interposed between said circumferentially spaced locations of said marking indicia; and said anvil comprises a cylindrical member for selective disposition within one of said recesses of said discs so as to rotatably fix said discs within said marking device whereby predetermined ones of said marking indicia are disposed at a marking position.

13. A marking device as set forth in claim 1, wherein:

said at least one marking punch comprises a plurality of polygonally-shaped, coaxially disposed discs each of which has a plurality of marking indicia mounted thereon at circumferentially spaced locations, and a plurality of vertex portions, defined at circumferentially spaced locations interposed between said circumferentially spaced locations of said marking indicia; and said anvil comprises a cylindrical member having substantially V-shaped groove means defined within a peripheral portion thereof for selectively housing one of said vertex portions of said discs so as to rotatably fix said discs within said marking device whereby predetermined ones of said marking indicia are disposed at a marking position.

14. A marking device as set forth in claim 1, wherein:

said at least one marking punch is mounted within channel means defined within said anvil.

15. A marking device as set forth in claim 14, wherein:

A plurality of channel means is defined within said anvil for housing a plurality of marking punches.

16. A marking device as set forth in claim 14 wherein:

a free face portion of said anvil which is disposed toward an object to be marked by said marking device has a substantially arcuate configuration for marking said object having an arcuate surface to be marked.

17. A marking device as set forth in claim 15, wherein:

a free face portion of said anvil which is disposed toward an object to be marked by said marking device has a substantially arcuate configuration for marking said object having an arcuate surface to be marked.

18. A marking device as set forth in claim 1, further comprising:

damping means incorporated within said case for absorbing excessive impact forces of said marking device upon an object to be marked.

19. A marking device as set forth in claim 18, wherein:

said damping means comprises a resilient toroid fixedly disposed within a front face portion of said case which is disposed toward said object to be marked.

20. A marking device as set forth in claim 1, further comprising:

groove means defined within said at least one marking punch; and pin means disposed within said case for disposition within said groove means of said at least one marking punch so as to substantially fixedly retain said at least one marking punch within said case.

21. A marking device as set forth in claim 14, further comprising:

groove means defined within said at least one marking punch; and rib means integrally formed within said anvil for disposition within said groove means of said at least one marking punch so as to substantially fixedly retain said at least one marking punch within said anvil.

22. A marking device as set forth in claim 1, further comprising:

slot means defined within wall portions of said case at positions adjacent to said anvil for providing resilient flexibility to said case in response to said movement of said anvil under the influence of said actuating force of said piston.

23. A marking device as set forth in claim 1, wherein:

said case comprises a resiliently deformable material.

24. A marking device as set forth in claim 23, wherein:

said material comprises polyurethane.

25. A marking device as set forth in claim 1, wherein:

said anvil is disposed internally within said case so as to be substantially enveloped by said case.

* * * * *